US007380845B2

(12) United States Patent
Suzumura et al.

(10) Patent No.: US 7,380,845 B2
(45) Date of Patent: Jun. 3, 2008

(54) VEHICLE DOOR LOCK DEVICE

(75) Inventors: Makoto Suzumura, Chita (JP); Akira Muramatsu, Chiryu (JP); Sigeru Tanabe, Obu (JP); Yukinobu Kunimatsu, Toyoake (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 24 days.

(21) Appl. No.: 11/356,041

(22) Filed: Feb. 17, 2006

(65) Prior Publication Data

US 2006/0186675 A1 Aug. 24, 2006

(30) Foreign Application Priority Data

Feb. 22, 2005 (JP) ..... 2005-046162

(51) Int. Cl.
*E05C 3/06* (2006.01)

(52) U.S. Cl. ..... 292/216; 292/DIG. 23

(58) Field of Classification Search ..... 292/216, 292/201, DIG. 23
See application file for complete search history.

(56) References Cited

U.S. PATENT DOCUMENTS 5,582,444 A * 12/1996 Hayakawa et al. ..... 292/216
6,131,967 A * 10/2000 Kondo et al. ..... 292/201
6,189,940 B1 * 2/2001 Hayakawa et al. ..... 292/216
6,722,714 B2 * 4/2004 Ooe et al. ..... 292/216
6,951,355 B2 10/2005 Hayakawa et al.

FOREIGN PATENT DOCUMENTS

| | | |
|---|---|---|
| DE | 101 12 787 A1 | 6/2003 |
| EP | 1 445 404 A2 | 8/2004 |
| JP | 2003-328623 A | 11/2003 |

OTHER PUBLICATIONS

Extended European Search Report issued by the European Patent Office in corresponding EP Patent Application No. 06 10 1157, Feb. 5, 2008, Munich, DE.

* cited by examiner

*Primary Examiner*—Gary Estremsky
(74) *Attorney, Agent, or Firm*—Buchanan Ingersoll & Rooney PC

(57) ABSTRACT

A vehicle door lock device includes a base member on which a pivot shaft is supported, a first lever rotatably supported on the pivot shaft, a second lever rotatably supported on the pivot shaft and operated in association with a door handle, an engaging member including an engaging pin for engaging the first lever and the second lever with each other in a predetermined engaging position and disengaging from each other in a predetermined release position, and an operating bringing the engaging pin to operate between the engaging position and the release position. The first lever, the second lever, the engaging member, and the operating member are arranged on one side of the base member. The base member includes a restricting projection portion on the one side for restricting a movement of the engaging pin as in the release position in a peripheral direction relative to the pivot shaft.

17 Claims, 13 Drawing Sheets

VEHICLE DOOR LOCK DEVICE

CROSS REFERENCE TO RELATED APPLICATIONS

This application is based on and claims priority under 35 U.S.C. § 119 to Japanese Patent Application No. 2005-046162, filed on Feb. 22, 2005, the entire content of which is incorporated herein by reference.

FIELD OF THE INVENTION

This invention generally relates to a vehicle door lock device.

BACKGROUND

A known vehicle door lock device includes a mechanism for prohibiting a release of engagement between a vehicle door and a vehicle body by means of an operation of a door handle. Such the vehicle door lock device is disclosed in JP2003-328623A. The door lock device disclosed is equipped with a child lock mechanism (i.e. a child proof mechanism) for prohibiting a release of engagement between a vehicle door and a vehicle body by means of an operation of an inside handle.

Precisely, as sown in FIG. 14, the vehicle door lock device disclosed includes a housing 101, an inside lever 102 arranged on the housing 101 and operated in association with the inside handle of the vehicle door, an open lever 103 linked to a latch mechanism for engaging the vehicle door with the vehicle body, and a child lock lever (i.e. a child proof lever) 104 for performing an operation such that an unlocked state in which the latch mechanism is operated by means of an operation of the inside handle, and a child lock state (i.e. a child proof lock state) in which the latch mechanism is inoperative by means of the operation of the inside handle are switched therebetween. In this case, the inside lever 102 and the open lever 103 are provided on respective faces of the housing 101, i.e. faces on a vehicle interior side and a vehicle exterior side. In addition, the child lock lever 104 includes an input sub-lever 104A and an action sub-lever 104B connected to the input sub-lever 104A. The input sub-lever 104A that includes an operation shaft 104Aa operated by a passenger and the like is arranged so as to be slidable and rotatable relative to the housing 101. The action sub-lever 104B includes a link shaft 104Ba on one end side, extending towards the housing 101. The link shaft 104Ba is integrally inserted into an elongated bore 102*a* or 102*b* of the inside lever 102, an elongated bore 101*a* or 101*b* of the housing 101, and an elongated bore 103*a* of the open lever 103.

Then, as shown in FIG. 15A, the operation of the operation shaft 104Aa causes the link shaft 104Ba of the action sub-lever 104B to vertically move in the elongated bore 102*a* of the inside lever 102 and the elongated bore 103*a* of the open lever 103, thereby switching the unlocked state and the child lock state therebetween. In this case, the link shaft 104Ba also moves in the elongated bores 101*a* and 101*b* of the housing 101 that is disposed between the inside lever 102 and the open lever 103. FIG. 15B shows a state in which the operation shaft 104Aa is operated in a downward direction and thus the link shaft 104Ba of the action sub-lever 104B is in a substantially upper end position of the elongated bore 102*a* of the inside lever 102 and the elongated bore 103*a* of the open lever 103. That is, the link shaft 104Ba is in a child lock position (i.e. a child proof lock position).

According to the aforementioned vehicle door lock device, as shown in FIG. 15B, when the inside handle is operated and thus the inside lever 102 is rotated in the counterclockwise direction in a sate in which the link shaft 104Ba of the action sub-lever 104B is in the child lock position, the open lever 103 may hit a lock link that is engageable with the open lever 103 in case of the door lock release, thereby generating a hitting noise. That is, in the state shown in FIG. 15B, a rightward movement of the link shaft 104Ba is not restricted by the elongated bore 102*a* of the inside lever 102 and thus the open lever 103 is rotatable in a counterclockwise direction in the elongated bore 101*a* of the housing 101. At this time, the elongated bore 101*a* of the housing 101 has a sufficient width relative to a diameter of the link shaft 104Ba. Therefore, the open lever 103 is rotatable within an angle corresponding to sufficiency of width of the elongated bore 101*a* relative to the link shaft 104Ba. The open lever 103 may be rotated because of vibration of the vehicle and the like, which leads to a hitting of the open lever 103 to the lock link.

Further, according to the aforementioned vehicle door lock device, the inside lever 102 and the open lever 103 are arranged on the respective faces of the housing 101, i.e. faces on the vehicle interior side and the vehicle exterior side. Then, the elongated bores 101*a* and 101*b* into which the link shaft 104Ba of the action sub-lever 104B is inserted are formed on the housing 101. Accordingly, sealing ability of the housing 101 for covering the vehicle door lock device may be reduced, which may prevent improvement of waterproof property of the vehicle door lock device.

Thus, a need exists for a vehicle door lock device that can achieve prevention of a hitting noise caused by a lever vibration and improvement of sealing ability.

SUMMARY OF THE INVENTION

According to an aspect of the present invention, a vehicle door lock device includes a base member on which a pivot shaft is supported, a first lever rotatably supported on the pivot shaft and linked to a latch mechanism engageable with a striker provided on a vehicle, a second lever rotatably supported on the pivot shaft and operated in association with a door handle, an engaging member supported on the first lever so as to be slidable relative thereto and including an engaging pin for engaging the first lever and the second lever with each other in a predetermined engaging position and disengaging the first lever and the second lever from each other in a predetermined release position displaced from the engaging position, and an operating lever linked to the engaging member and bringing the engaging pin to operate between the engaging position and the release position. The first lever, the second lever, the engaging member, and the operating member are arranged on one side of the base member. The base member includes a restricting projection portion on the one side for restricting a movement of the engaging pin as in the release position in a peripheral direction relative to the pivot shaft.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 13:
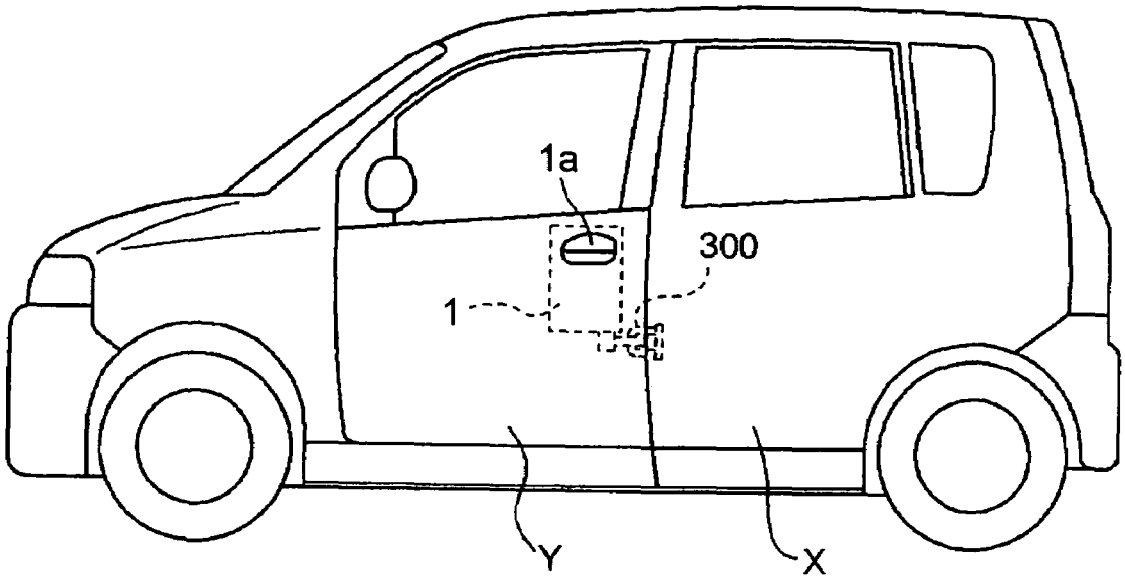
FIG. 13 is a side view of a vehicle equipped with the vehicle door lock device according to the present embodiment.
Figure 14:
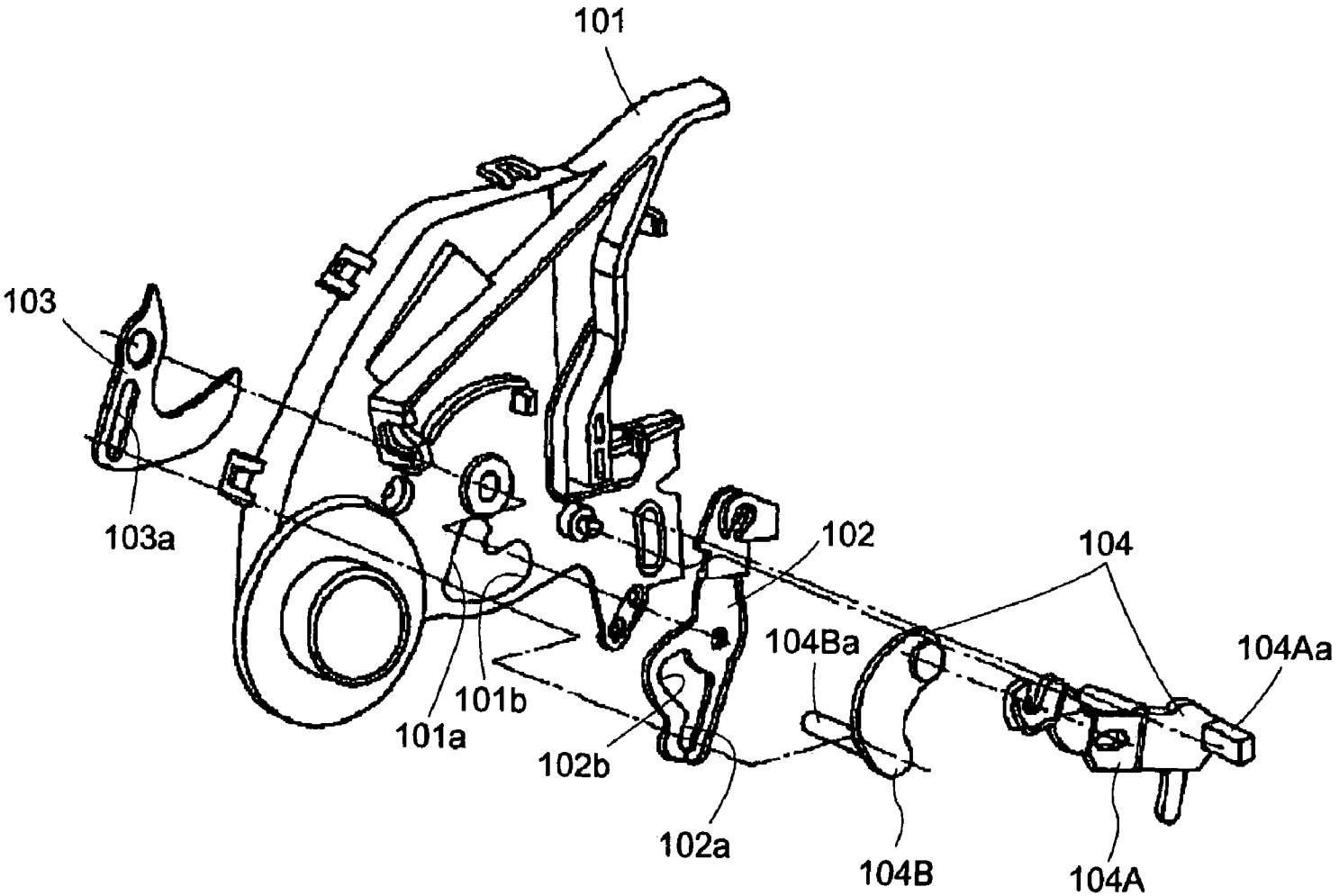
FIG. 14 Prior art
FIG. 14 is an exploded perspective view of a conventional vehicle door lock device.
Figure 15:
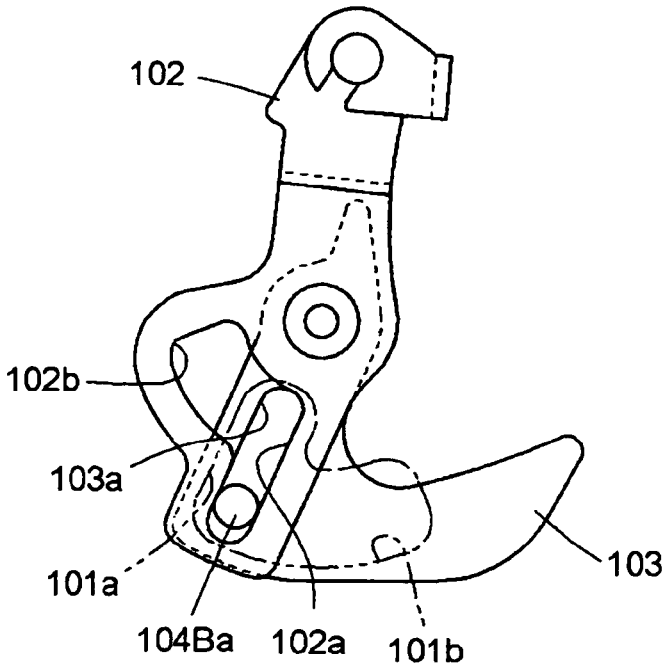
F I G. 15 A Prior art
FIG. 15A is a view showing a child lock release state (i.e. a child proof release state) of an inside lever, an open lever, and a link shaft of a child lock lever according to the conventional vehicle door lock device.
FIG. 15B is a view showing a child lock state (i.e. a child proof lock state) of an inside lever, an open lever, and a link shaft of a child lock lever according to the conventional vehicle door lock device.
Figure 15:
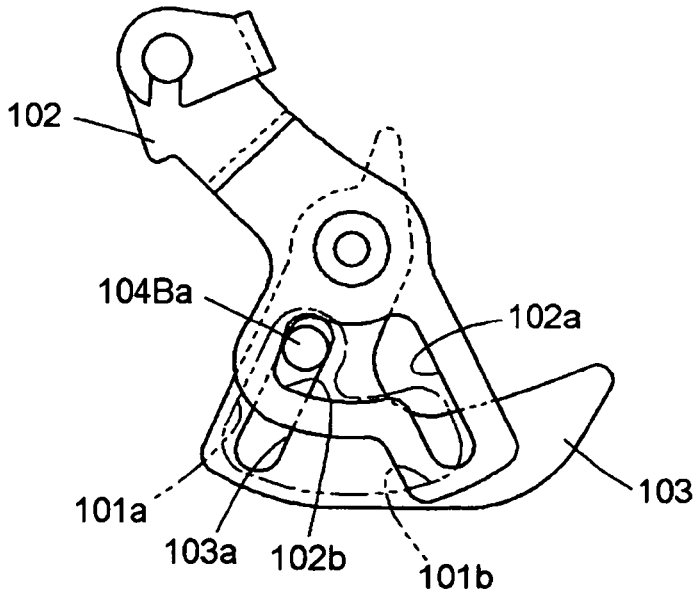
F I G. 15 B Prior art

An embodiment of the present invention is explained with reference to the attached drawings. FIG. 13 is a schematic view showing a state in which a vehicle door lock device 1 according to the present embodiment is installed in a vehicle door Y. The vehicle door lock device 1 is arranged so as to face a striker 300 provided on a vehicle body X in cases where the vehicle door Y is closed. The vehicle door Y can be a hinged door, a sliding door, or the like. The vehicle door lock device 1 is connected to an outside door handle 1*a* and an inside door handle (not shown).

Figure 1:
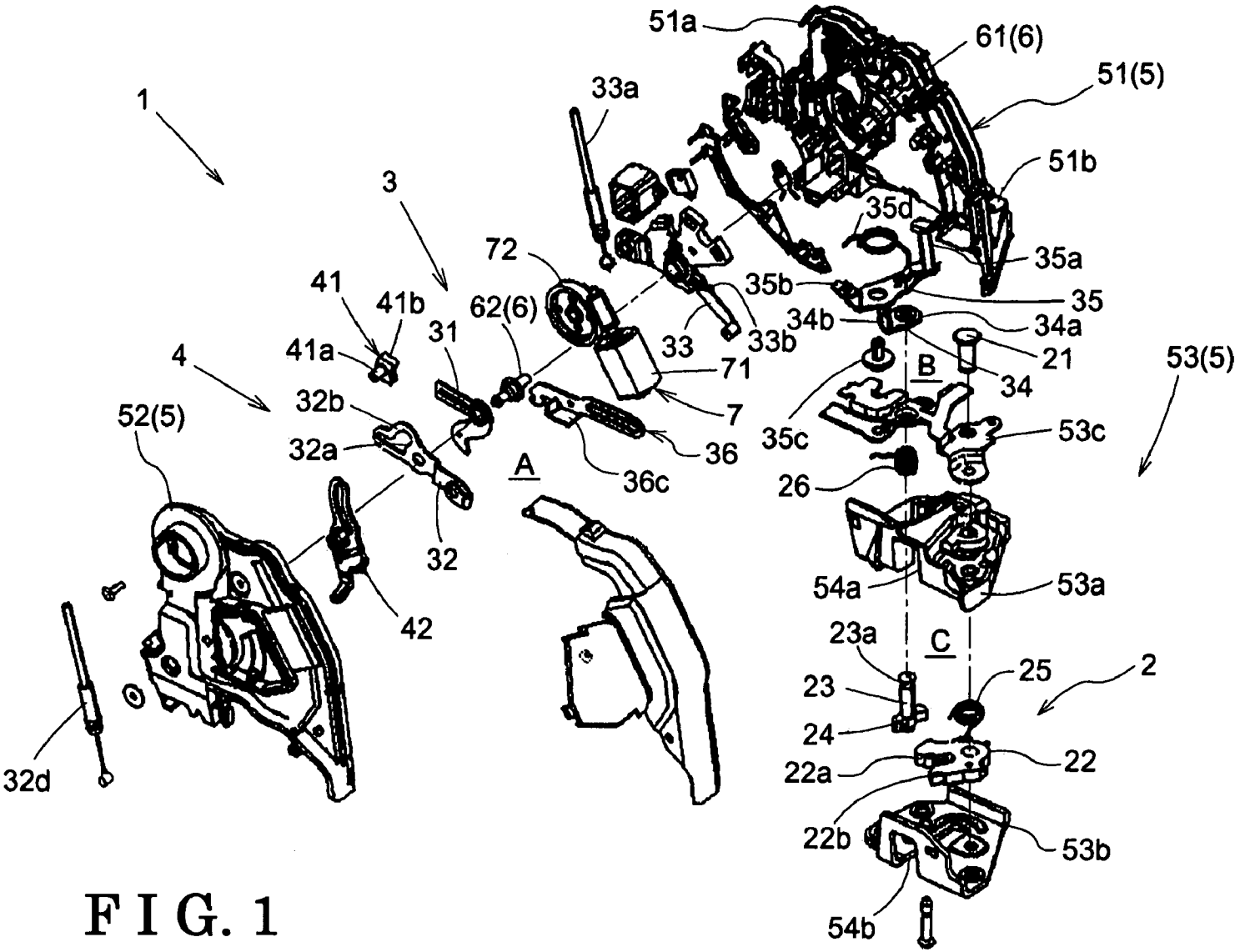
FIG. 1 is an exploded perspective view of a vehicle door lock device according to an embodiment of the present invention.

FIG. 1 is an exploded perspective view of the vehicle door lock device 1 according to the present embodiment. As shown in FIG. 1, the vehicle door lock device 1 includes a latch mechanism 2 for engaging with or disengaging from the striker 300 (see FIG. 13) secured to the vehicle body X so as to bring the vehicle door Y to engage with the vehicle body X, a link mechanism 3 operated in association with an operation of the outside door handle 1*a* or the inside door handle so as to operate the latch mechanism 2, a child lock mechanism (i.e. a child proof mechanism) 4 for prohibiting the latch mechanism 2 to operate regardless of the operation of the inside door handle, and a housing 5 for accommodating therein the latch mechanism 2, the link mechanism 3, and the child lock mechanism 4.

The housing 5 includes a main case 51, a first cover 52, and a second cover 53. According to the present embodiment, the main case 51 and the first cover 52 are made of synthetic resin. The main case 51 includes a first case portion 51*a* and a second case portion 51*b* arranged next to the first case portion 51*a*.

The first cover 52 is arranged so as to cover the first case portion 51*a* of the main case 51. A hermetically sealed first accommodating space A is formed, being surrounded by the first case portion 51*a* and the first cover 52. According to the present embodiment, the first cover 52 of the housing 5 constitutes a base member. The second cover 53 is arranged so as to cover the second case portion 51*b* of the main case 51. A second accommodating space B is formed, being surrounded by the second case portion 51*b* and the second cover 53. A pivot shaft 6 is arranged in a substantially middle position of the first accommodating space A for the purposes of supporting an inside open lever 31, an inside lever 32, and a locking lever 33 to be mentioned later. The pivot shaft 6 consists of a shaft supporting portion 61 formed in a projecting manner on the main case 51, and a shaft main body 62 whose both ends are respectively supported by the shaft supporting portion 61 and a supported portion (not shown) formed on the first cover 52. The second cover 53 includes a box-shaped second cover main body 53*a*, a base plate 53*b* arranged on an outer side (i.e. a side separated from the second case portion 51*b*) of the second cover main body 53*a*, and a sub-base plate 53*c* arranged on an inner side (i.e. a side close to the second case portion 51*b*) of the second cover main body 53*a*. In this case, the second cover main body 53*a* is made of synthetic resin while the base plate 53*b* and the sub-base plate 53*c* are made of metal plate. The second cover main body 53*a* is attached to the main case 51 by means of the sub-base plate 53*c*. A third accommodating space C is formed, being surrounded by the base plate 53*b* and the second cover main body 53*a*. In addition, groove portions 54*a* and 54*b*, through which the striker 300 secured to the vehicle body X is inserted in case of opening/closing of the vehicle door Y, are respectively formed on the second cover main body 53*a* and the base plate 53*b*.

The latch mechanism 2 is arranged in the third accommodating space C surrounded by the second cover main body 53*a* and the base plate 53*b*. The latch mechanism 2 includes a latch shaft 21 whose both ends are respectively supported by the second cover main body 53*a* and the base plate 53*b*, a latch 22 rotatably supported by the latch shaft 21 relative to the base plate 53*b*, a pawl shaft 23 arranged in parallel with the latch shaft 21 and whose both ends are respectively supported by the second cover main body 53*a* and the base plate 53*b*, and a pawl 24 formed as a unit with the pawl shaft 23 and thereby rotatably supported relative to the base plate 53*b*. An engaging groove 22*a* that engages with the striker 300 (see FIG. 13) on the vehicle body X side, and a hook portion 22*b* engaging with the pawl 24 are formed on a peripheral face of the latch 22. The latch 22 is rotatably biased in one direction by means of a latch spring 25 formed on an outer periphery of the latch shaft 21. The pawl 24 is rotatably biased in the other direction, which is an opposite direction to that the latch 22 is biased, by means of a pawl spring 26 formed on an outer periphery of the pawl shaft 23.

The latch mechanism 2 is brought in two states, i.e. a latched state and an unlatched state. In the latched state, the latch 22 is rotated with the striker 300 (see FIG. 13) engaging with the engaging groove 22*a* of the latch 22 in such a manner that an opening direction of the engaging groove 22*a* intersects with that of the groove portions 54*a* and 54*b* respectively formed on the second cover main body 53*a* and the base plate 53*b*. At this time, the pawl 24 engages with the hook portion 22*b* of the latch 22. With this engagement between the pawl 24 and the latch 22, the latch 22 is restricted to rotate in one direction by means of the biasing force of the latch spring 25 and retained to engage with the striker 300. Therefore, the vehicle door Y is retained in a closed state relative to the vehicle body X. Meanwhile, when the pawl 24 is rotated against the biasing force of the pawl spring 26 from the latched state, the engagement between the hook portion 22*b* of the latch 22 and the pawl 24 is released. Then, the latch 22 is rotated in one direction by means of the biasing force of the latch spring 25. Accordingly, the opening direction of the engaging groove 22*a* of the latch 22 and that of the groove portions 54*a* and 54*b* match with each other, thereby causing the striker 300 to move along the groove portions 54*a* and 54*b*, i.e. move relative thereto. The striker 300 is brought in the unlatched state in which the striker 300 is disengageable from the engaging groove 22*a* of the latch 22. The vehicle door Y can be opened relative to the vehicle body X accordingly.

As shown in FIGS. 1 to 8, the link mechanism 3 includes a lift lever 34, an outside open lever 35, an open link 36, an inside open lever 31, an inside lever 32, and a locking lever 33. The lift lever 34 and the outside open lever 35 are arranged in the second accommodating space B while the open link 36, the inside open lever 31, the inside lever 32, and the locking lever 33 are arranged in the first accommodating space A.

The pawl shaft 23 formed as a unit with the pawl 24 projects into the second accommodating space B by penetrating through the second cover main body 53*a* and the sub-base plate 53*c*. The lift lever 34 is secured to a projecting portion 23*a* of the pawl shaft 23 so as to rotate as a unit with the pawl shaft 23. In addition, a flange portion 34*b* is formed on the lift lever 34 so as to extend substantially vertical to a rotating face of a lift lever main body 34*a* positioned around the pawl shaft 23.

Figure 2:
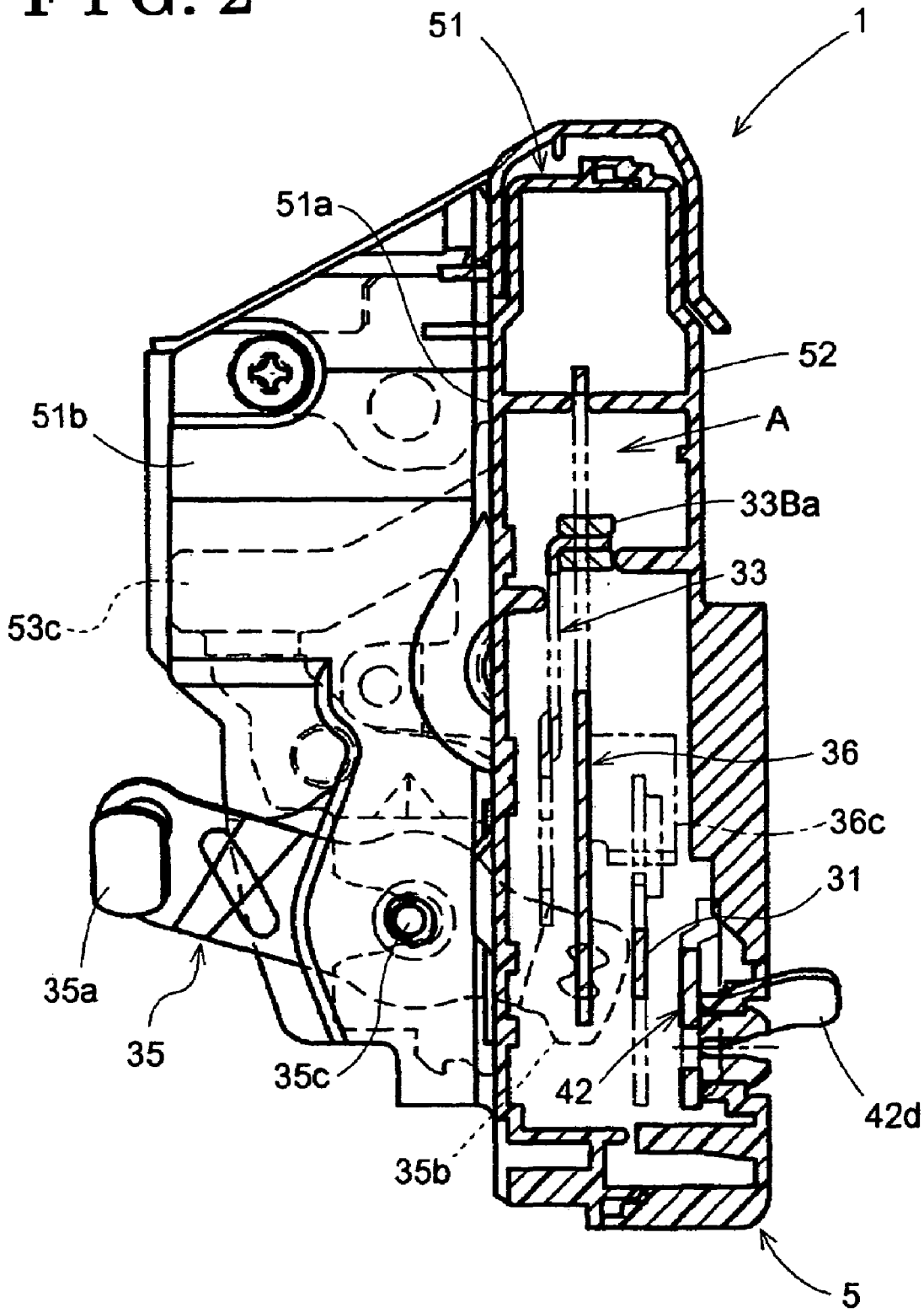
FIG. 2 is a side cross-sectional view of the vehicle door lock device according to the embodiment of the present invention.

As shown in FIG. 2, the outside open lever 35 is supported on the sub-base plate 53*c* so as to be rotatable relative thereto by means of a lever shaft 35*c* secured to the sub-base plate 53*c*. The outside open lever 35 is connected to the outside door handle 1*a* formed on the vehicle door Y in such a manner that the outside open lever 35 is rotated relative to the lever shaft 35*c* by means of the operation of the outside door handle 1*a* through a link pin 35*a* formed in a projecting manner on one end portion of the outside open lever 35. In addition, the outside open lever 35 is biased by means of a biasing spring 35*d* disposed on an outer peripheral side of the lever shaft 35*c* in a direction in which the outside open lever 35 is retained in an initial position when the outside door handle 1*a* is not operated.

Figure 3:
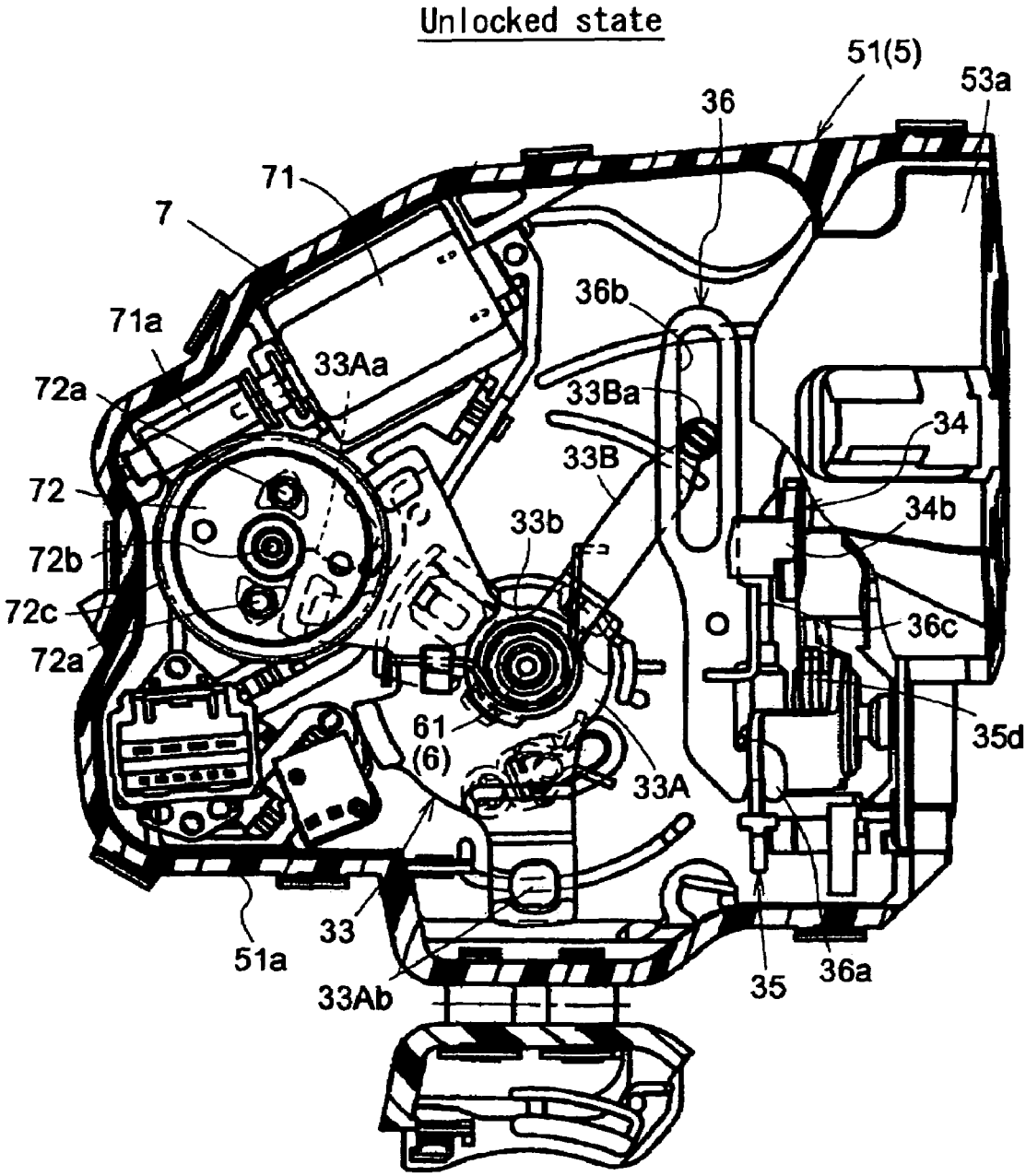
FIG. 3 is an internal structural view of a portion of a link mechanism of the vehicle door lock device as viewed from a front side (unlocked state) according to the embodiment of the present invention.
Figure 4:
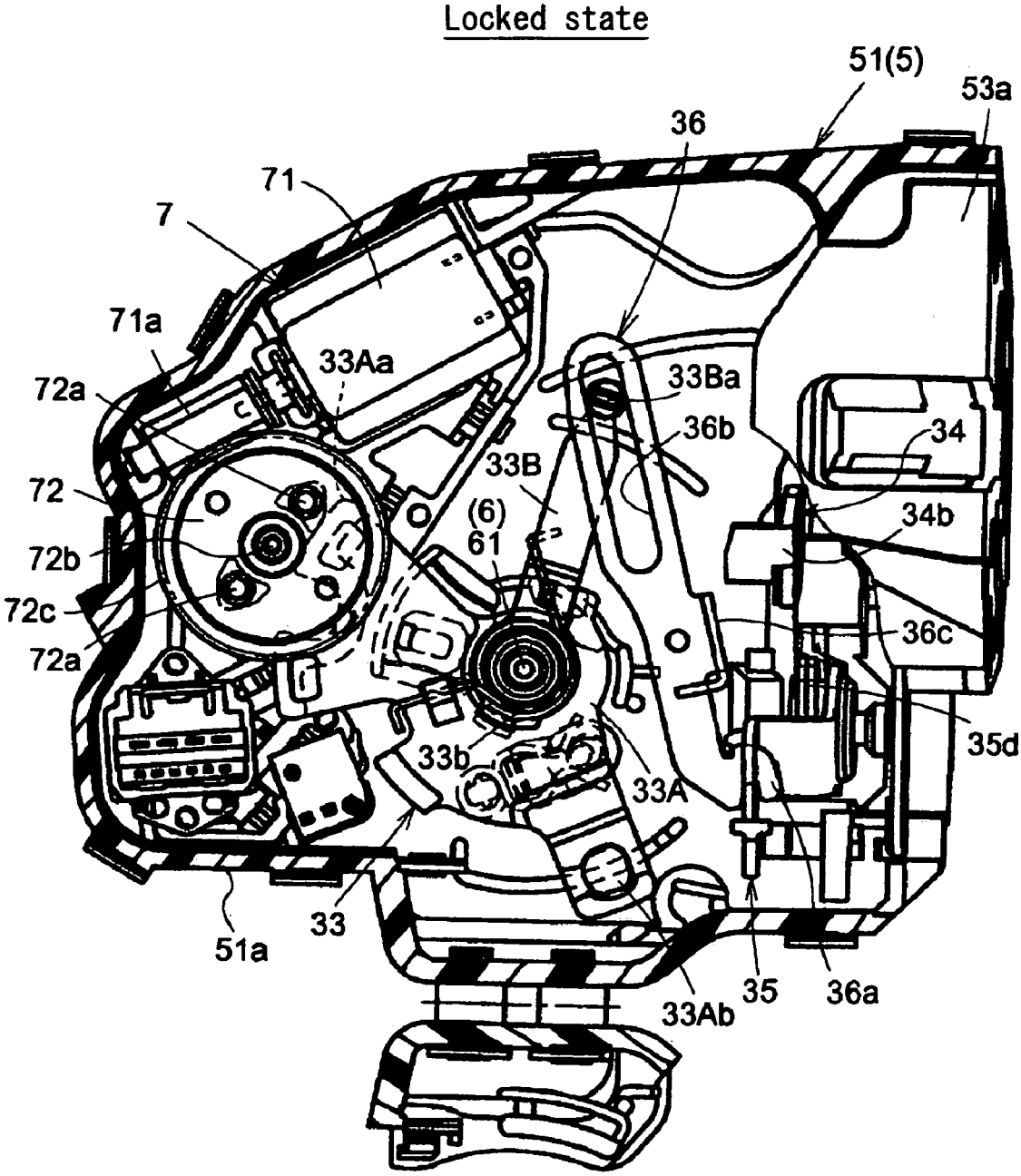
FIG. 4 is an internal structural view of a portion of the link mechanism of the vehicle door lock device as viewed from the front side (locked state) according to the embodiment of the present invention.

As shown in FIGS. 2 to 4, the open link 36 is arranged substantially perpendicular to the outside open lever 35. A base portion 36*a* of the open link 36 is supported by a supporting portion 35*b* of the outside open lever 35 formed on one end portion thereof that is arranged opposite to the other end portion where the link pin 35*a* is formed. Then, the open link 36 is rotatable between an unlocked position as shown in FIG. 3 and a locked position as shown in FIG. 4. When the open link 36 is in the unlocked position, the vehicle door lock device 1 is in an unlocked state while the vehicle door lock device 1 is in a locked state when the open link 36 is in the locked position. When the vehicle door lock device 1 is in the unlocked state, the latch mechanism 2 is operated by the operation of the inside door handle or the outside door handle 1*a* (see FIG. 13) in the closed state of the vehicle door Y, thereby achieving the opening operation of the vehicle door Y. Meanwhile, when the vehicle door lock device 1 is in the locked state, the latch mechanism 2 is not operated by the operation of the inside door handle or the outside door handle 1*a* in the closed state of the vehicle door Y, thereby failing to achieve the opening operation of the vehicle door Y. An elongated bore 36*b* is formed in the vicinity of a tip end portion of the open link 36 along a longitudinal direction thereof. Further, a contact portion 36*c* projecting in a thickness direction thereof and having an L-shape in cross section is formed on a middle portion of the open link 36. An upper end portion of the contact portion 36*c* is able to contact with the flange portion 34*b* of the lift lever 34 as shown in FIG. 3 while a lower end portion of the contact portion 36*c* is able to contact with the inside open lever 31 as shown in FIG. 2.

Figure 5:
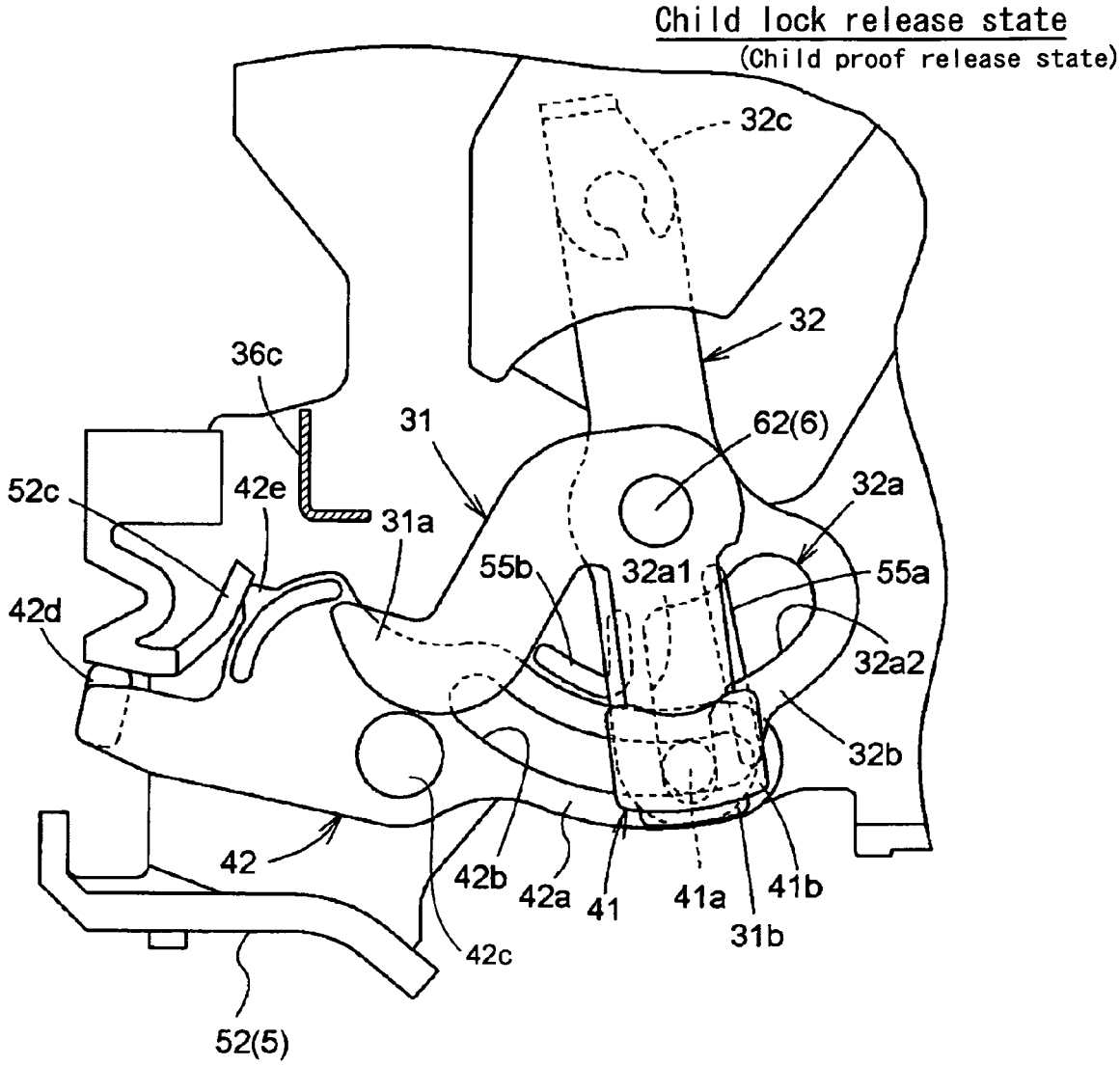
FIG. 5 is an internal structural view of a portion of the link mechanism and a child lock mechanism of the vehicle door lock device as viewed from a rear side (child lock release state) according to the embodiment of the present invention.
Figure 6:
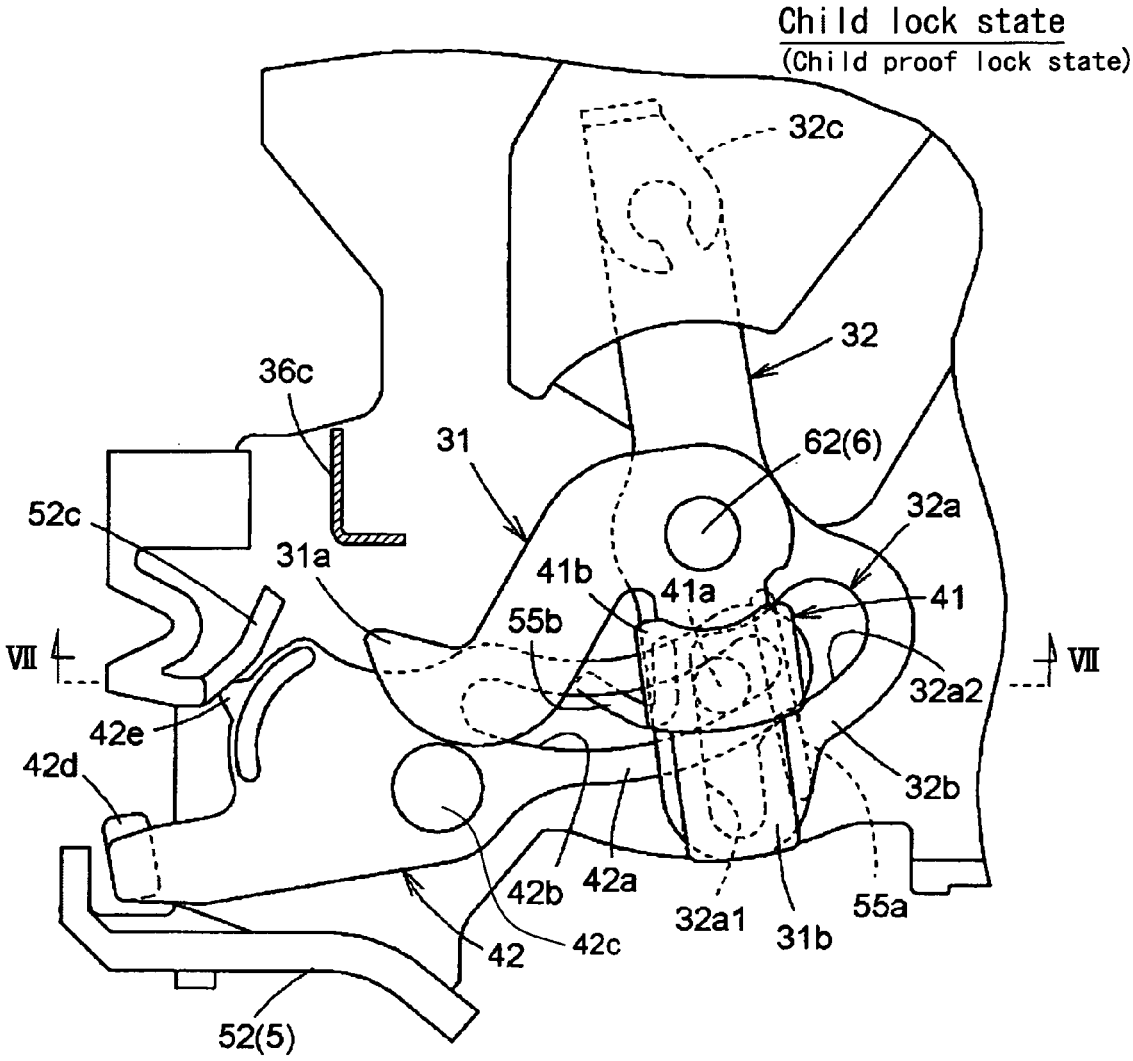
FIG. 6 is an internal structural view of a portion of the link mechanism and the child lock mechanism of the vehicle door lock device as viewed from the rear side (child lock state) according to the embodiment of the present invention.

The inside open lever 31 is rotatably supported by the shaft main body 62 of the pivot shaft 6. As shown in FIGS. 2 and 5, an arm portion 31*a* projecting in a leftward direction in FIG. 5 is formed on one end side of the inside open lever 31 so as to be able to contact with the contact portion 36*c* of the open link 36 from a lower side. In addition, as shown in FIGS. 5 and 6, a slide bush supporting portion 31*b* projecting in a downward direction in FIGS. 5 and 6 is formed on the other end side of the inside open lever 31 so as to support a slide bush 41 in such a manner that the slide bush 41 constituting the child lock mechanism 4 is slidable. In this case, the slide bush supporting portion 31*b* has a substantially rectangular plate shape extending in a sliding direction of the slide bush 41. According to the present embodiment, the inside open lever 31 constitutes a first lever.

The inside lever 32 is rotatably supported by the shaft main body 62 of the pivot shaft 6. As shown in FIGS. 5 and 6, an elongated bore 32*a* projecting in a downward direction in FIGS. 5 and 6 and through which an engaging pin 41*a* of the slide bush 41 is inserted is formed on one end side of the inside lever 32. In addition, on one end side of the inside lever 32, an open lever link portion 32*b* is provided for the purposes of linking to the inside open lever 31 by means of the slide bush 41. The elongated bore 32*a* includes a linear bore portion 32*a*1 linearly formed along a longitudinal direction (i.e. vertical direction in FIGS. 5 and 6) of the open lever link portion 32*b* and an arc-shaped bore portion 32*a*2 extending from an upper end portion of the linear bore portion 32*a*1 in a counterclockwise direction in FIGS. 5 and 6 in a substantially arc-shaped manner relative to the pivot shaft 6. That is, the elongated bore 32*a* has a substantially L-shape. The inside lever 32 and the inside open lever 31 engage with or disengage from each other by means of the effect of the elongated bore 32*a* on the open lever link portion 32*b* and the engaging pin 41*a* of the slide bush 41. Further, a door handle link portion 32*c* is formed on the other end side of the inside lever 32 and with which one end of a cable 32*d* (see FIG. 1) linked to the inside door handle engages. According to the present embodiment, the inside lever 32 constitutes a second lever.

The locking lever 33 includes an active lever 33A and a sub-lever 33B as shown in FIGS. 3 and 4. The active lever 33A and the sub-lever 33B are rotatably supported around the shaft supporting portion 61 of the pivot shaft 6. An engaging recess portion 33Aa linked to an actuator 7 to be mentioned later is formed, projecting in an upper-left direction in FIG. 3, on one end side of the active lever 33A. Meanwhile, a lock knob link portion 33Ab is formed, projecting in a downward direction in FIG. 3, on the other end side of the active lever 33A. One end of a cable 33*a* (see FIG. 1) linked to a lock knob (not shown) that is formed on an interior side of the vehicle door Y engages with the lock knob link portion 33Ab. Thus, the active lever 33A is rotated in an unlocked direction (i.e. clockwise direction in FIGS. 3 and 4) or in a locked direction (i.e. a counterclockwise direction in FIGS. 3 and 4) of the vehicle door Y in association with the operation of the actuator 7 or the lock knob. The sub-lever 33B is formed, projecting in an upper-right direction in FIG. 3 relative to the active lever 33A. A tip end portion 33Ba of the sub-lever 33B is arranged, being inserted into the elongated bore 36*b* of the open link 36 so that the sub-lever 33B is linked to the open link 36. Then, the sub-lever 33B is rotated together with the active lever 33A in the unlocked direction of the vehicle door Y so that the position of the open link 36 is switched between the unlocked position (i.e. position shown in FIG. 3) and the locked position (i.e. position shown in FIG. 4). At this time, when the active lever 33A is rotated in the locked direction, the sub-lever 33B is rotated as a unit with the active lever 33A. On the other hand, when the active lever 33A is rotated in the unlocked direction, the sub-lever 33B is rotated relative to the active lever 33A and also constantly biased in a direction such that the sub-lever 33B is brought in an initial position relative to the active lever 33A (i.e. relative position shown in FIGS. 3 and 4) by means of a locking spring 33*b* arranged around the pivot shaft 6.

As shown in FIG. 1, the actuator 7 is arranged in the first accommodating space A for the purposes of driving the active lever 33A of the locking lever 33. The actuator 7 includes an electric motor 71 serving as a driving source, and a driving wheel 72 driven by the electric motor 71 and having engaging projections 72*a* respectively engageable with the engaging recess portion 33Aa of the active lever 33A. The driving wheel 72 is rotatably assembled on a wheel shaft 72*b* supported on the main case 51 of the housing 5. Then, as shown in FIGS. 3 and 4, a gear 72*c* engageable with a worm gear 71*a* arranged on a driving shaft of the electric motor 71 is formed on an outer periphery of the driving wheel 72 so that the driving wheel 72 is driven by the electric motor 71 via the gear 72*c*. In addition, the driving wheel 72 includes a pair of engaging projections 72*a* projecting on a backside in FIGS. 3 and 4. The pair of engaging projections 72*a* respectively engage with or disengage from the engaging recess portion 33Aa of the active lever 33A in association with the rotation of the driving wheel 72, thereby causing the active lever 33A to rotate in the unlocked direction or the locked direction. Thus, with the operation of the driving wheel 72, the position of the open link 36 is switched between the unlocked position and the locked position by means of the active lever 33A and the sub-lever 33B. The vehicle door Y is unlocked or locked accordingly.

The child lock mechanism 4 includes the slide bush 41 and an operating lever 42. In addition, the slide bush supporting portion 31*b* of the inside open lever 31 and the open lever link portion 32*b* of he inside lever 32 also constitute the child lock mechanism 4. The slide bush 41 and the operating lever 42 are arranged, as well as the inside open lever 31 and the inside lever 32, in the first accommodating space A of the housing 5.

Figure 7:
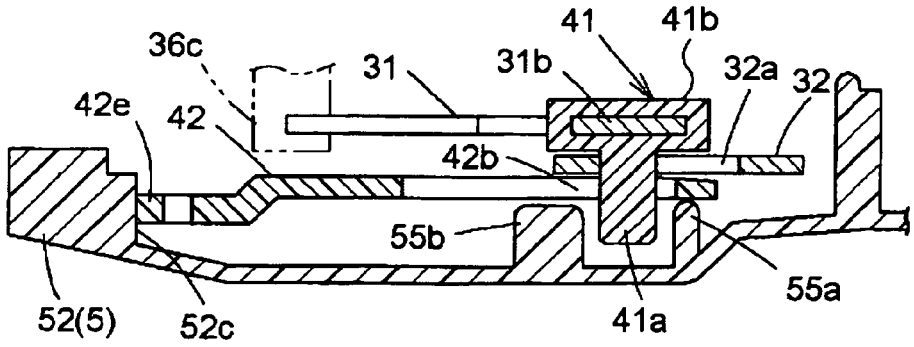
FIG. 7 is a cross-sectional view taken along the line VII-VII in FIG. 6.
Figure 8:
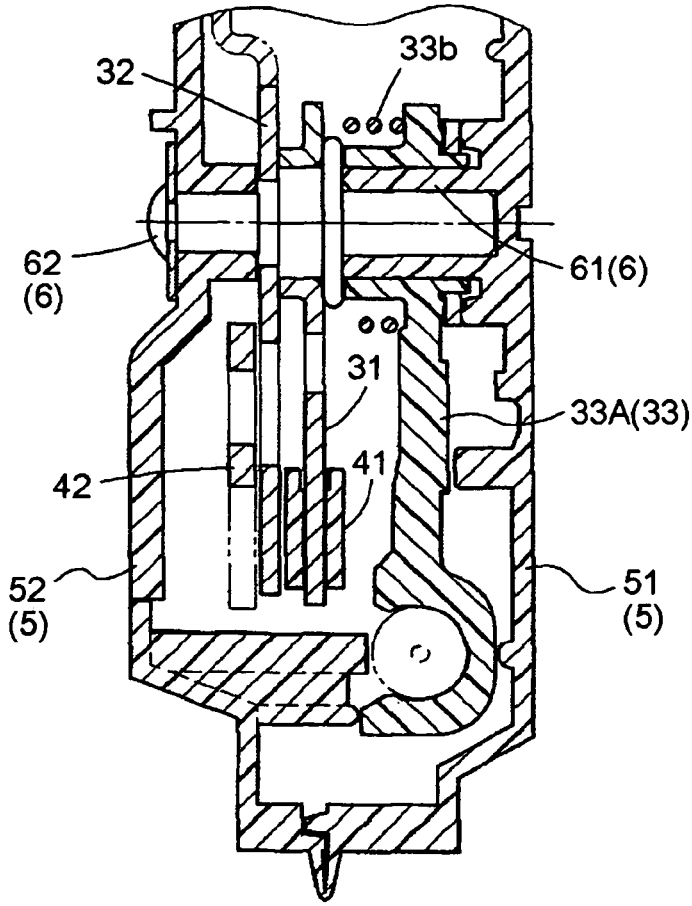
FIG. 8 is a longitudinal sectional view of the vehicle door lock device according to the present embodiment.

As shown in FIGS. 5 to 7, the slide bush 41 includes a slide bush main body 41*b* supported by the slide bush supporting portion 31*b* of the inside open lever 31, and the engaging pin 41*a* projecting from the slide bush main body 41*b* towards the inside lever 32 (i.e. downward direction in FIG. 7). As shown in FIG. 7, the slide bush supporting portion 31*b* of the inside open lever 31 is disposed into the slide bush main body 41*b* so that the slide bush main body 41*b* is slidable relative to the slide bush supporting portion 31*b* in a longitudinal direction thereof. The engaging pin 41*a* having a cylindrical shape is inserted into the elongated bore 32*a* formed on the open lever link portion 32*b* of the inside lever 32 and an arc-shaped elongated link bore 42*b* formed on an engaging pin link portion 42*a* provided on one side of the operating lever 42.

When the engaging pin 41*a* is positioned on an end side of the slide bush supporting portion 31*b* as shown in FIG. 5, the engaging pin 41*a* is inserted into the linear bore portion 32*a*1 of the elongated bore 32*a* of the inside lever 32 so as to bring the inside open lever 31 and the inside lever 32 in an engaging state by prohibiting the relative rotation between the inside open lever 31 and the inside lever 32. That is, a position in which the engaging pin 41*a* is on the end side of the slide bush supporting portion 31*b* as shown in FIG. 5 is an engaging position of the engaging pin 41*a*. In cases where the engaging pin 41*a* is in the engaging position, the vehicle door lock device 1 is in a child lock release state (i.e. a child proof release state) in which the child lock is ineffective. On the other hand, when the engaging pin 41*a* is positioned on a base side of the slide bush supporting portion 31*b* as shown in FIG. 6, the engaging pin 41*a* is inserted into the arc-shaped bore portion 32*a*2 of the elongated bore 32*a* of the inside lever 32 so as to bring the inside open lever 31 and the inside lever 32 in an engaging release state by allowing the relative rotation between the inside open lever 31 and the inside lever 32 along the arc-shaped bore portion 32*a*2. That is, a position in which the engaging pin 41*a* is on the base side of the slide bush supporting portion 31*b* as shown in FIG. 6 is a release position of the engaging pin 41*a*. In cases where the engaging pin 41*a* is in the release position, the vehicle door lock device 1 is in a child lock state (i.e. a child proof lock state) in which the child lock is effective. According to the present embodiment, the slide bush 41 constitutes an engaging member.

As shown in FIGS. 5 and 6, the operating lever 42 is rotatably supported by an operating lever shaft 42*c* secured to the first cover 52. The engaging pin link portion 42*a* is provided on one side of the operating lever 42 so as to extend in a rightward direction in FIGS. 5 and 6 and to include the arc-shaped elongated link bore 42*b* into which the engaging pin 41*a* is inserted. The operating lever 42 switches the position of the engaging pin 41*a* by rotating between a child lock release position (i.e. a child proof release position) shown in FIG. 5 in which the engaging pin 41*a* is in the engaging position, and a child lock position (i.e. a child proof lock position) shown in FIG. 6 in which the engaging pin 41*a* is in the release position.

Figure 10:
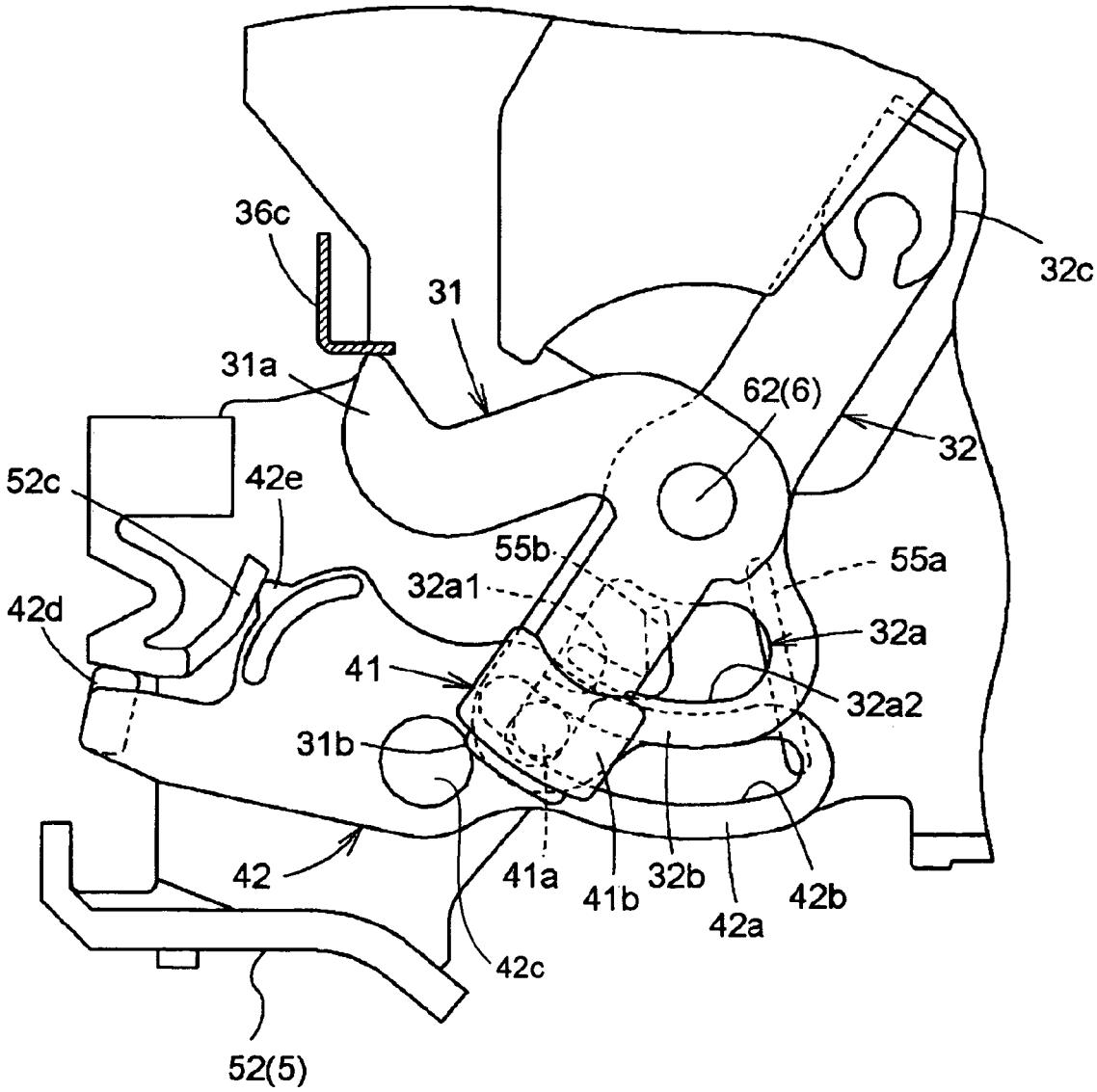
FIG. 10 is a view showing a state in which an inside door handle is operated from the child lock release state shown in FIG. 5.

The elongated link bore 42*b* is formed such that the inside lever 32 and the inside open lever 31 are allowed to rotate relative to the pivot shaft 6 when the inside door handle is operated as shown in FIG. 10 in a state in which the engaging pin 41*a* is in the engaging position, i.e. the operating lever 42 is in the child lock release position, as shown in FIG. 5. Precisely, as shown in FIG. 5, the elongated link bore 42*b* is in the arc shape relative to the pivot shaft 6 with the engaging pin 41*a* in the engaging position.

An operation portion 42*d* operable by a passenger and the like and projecting in an outward direction from the first accommodating space A surrounded by the first case portion 51*a* of the main case 51 and the first cover 52 as shown in FIG. 1 (i.e. leftward side in FIGS. 5 and 6) is provided on the other side of the operating lever 42. When the operation portion 42*d* is operated in a vertical direction in FIGS. 5 and 6, the operating lever 42 is rotated relative to the operating lever shaft 42*c*, thereby causing the engaging pin link portion 42*a* to move in the vertical direction. Thus, the engaging pin 41*a* can be operated along the slide bush supporting portion 31*b* of the inside open lever 31.

At this time, in order to bring the operating lever 42 to moderately rotate relative to the operating lever shaft 42*c*, an elastic projecting portion 42*e* that can be elastically deformed in a radial direction of the operating lever shaft 42*c* is formed on the operating lever 42. The elastic projecting portion 42*e* is arranged so as to be made contact with a contact wall 52*c* having a mountain-shape in cross section and formed on the first cover 52. The elastic projecting portion 42*e* slides along a surface of the contact wall 52*c* in association with the rotation of the operating lever 42. At this time, a moderate rotation of the operating lever 42 is obtained when the elastic projecting portion 42*e* passes over an apex of the contact wall 52*c*.

Figure 9:
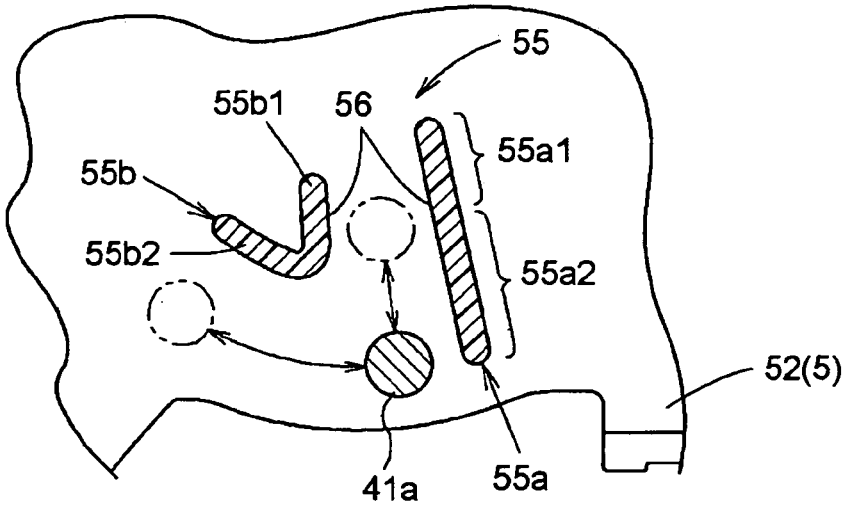
FIG. 9 is a view showing a shape of a guide portion formed on a first cover of the vehicle door lock device according to the present embodiment.

As shown in FIG. 9, a guide portion 55 is formed on the first cover 52 for the purposes of guiding an operating path of the engaging pin 41*a*. In this case, the engaging pin 41*a* should be movable between the engaging position shown in FIG. 5 and the release position shown in FIG. 6 by the slide bush 41 sliding along the slide bush supporting portion 31*b* in a state in which the inside open lever 31 and the inside lever 32 are in the initial position as shown in FIGS. 5 and 6. Further, the engaging pin 41*a* should be slidable from the initial position shown in FIG. 5 to the unlatched side (i.e. clockwise direction in FIG. 5) relative to the pivot shaft 6 along with the inside lever 32 and the inside open lever 31 when the inside door handle is operated in a state in which the engaging pin 41*a* is in the engaging position and thus the inside open lever 31 and the inside lever 32 engage with each other as shown in FIG. 10. Then, as shown in FIG. 7, the guide portion 55 includes a first guide portion 55*a* and a second guide portion 55*b* that are formed in a projecting manner on one side of the first cover 52 where the inside lever 32, the inside open lever 31, and the like are formed, for the purposes of guiding the operating path of the engaging pin 41*a*. The first guide portion 55*a* having a linear shape is formed on a vehicle installation side (i.e. latched side, rightward direction in FIG. 9) as shown in FIG. 9 while the second guide portion 55*b* having a substantially V-shape is formed on an unlatched side (i.e. leftward direction in FIG. 9). According to the present embodiment, the vehicle installation direction is an outward direction of the vehicle door Y where the vehicle door lock device 1 is formed, i.e. a direction opposite to that in which the operation portion 42*d* of the operating lever 42 projects. Further, the latched direction is opposite to the unlatched direction and also identical to the vehicle installation direction.

The second guide portion 55*b* includes a linear guide area 55*b*1 having a linear shape and facing the first guide portion 55*a*, and a pivot guide area 55*b*2 having an arc-shape and formed from an end portion of the linear guide area 55*b*1 along the rotation direction of the engaging pin 41*a* in the engaging position. The first guide portion 55*a* includes a first area 55*a*1 facing the linear guide area 55*b*1 of the second guide portion 55*b*, and a second area 55*a*2 not facing the second guide portion 55*b*.

Figure 11:
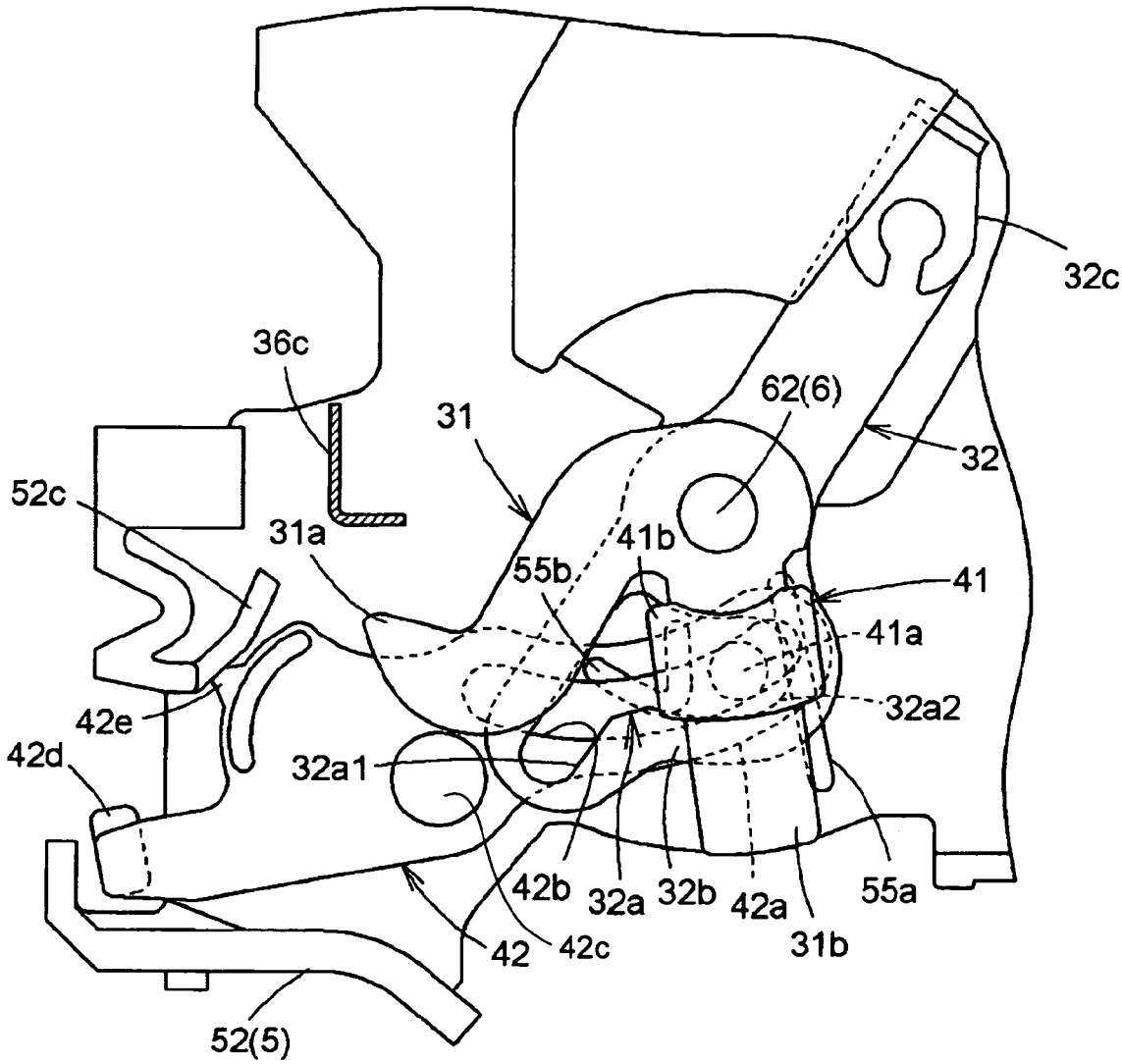
FIG. 11 is a view showing a state in which the inside door handle is operated from the child lock state shown in FIG. 6.
Figure 12:
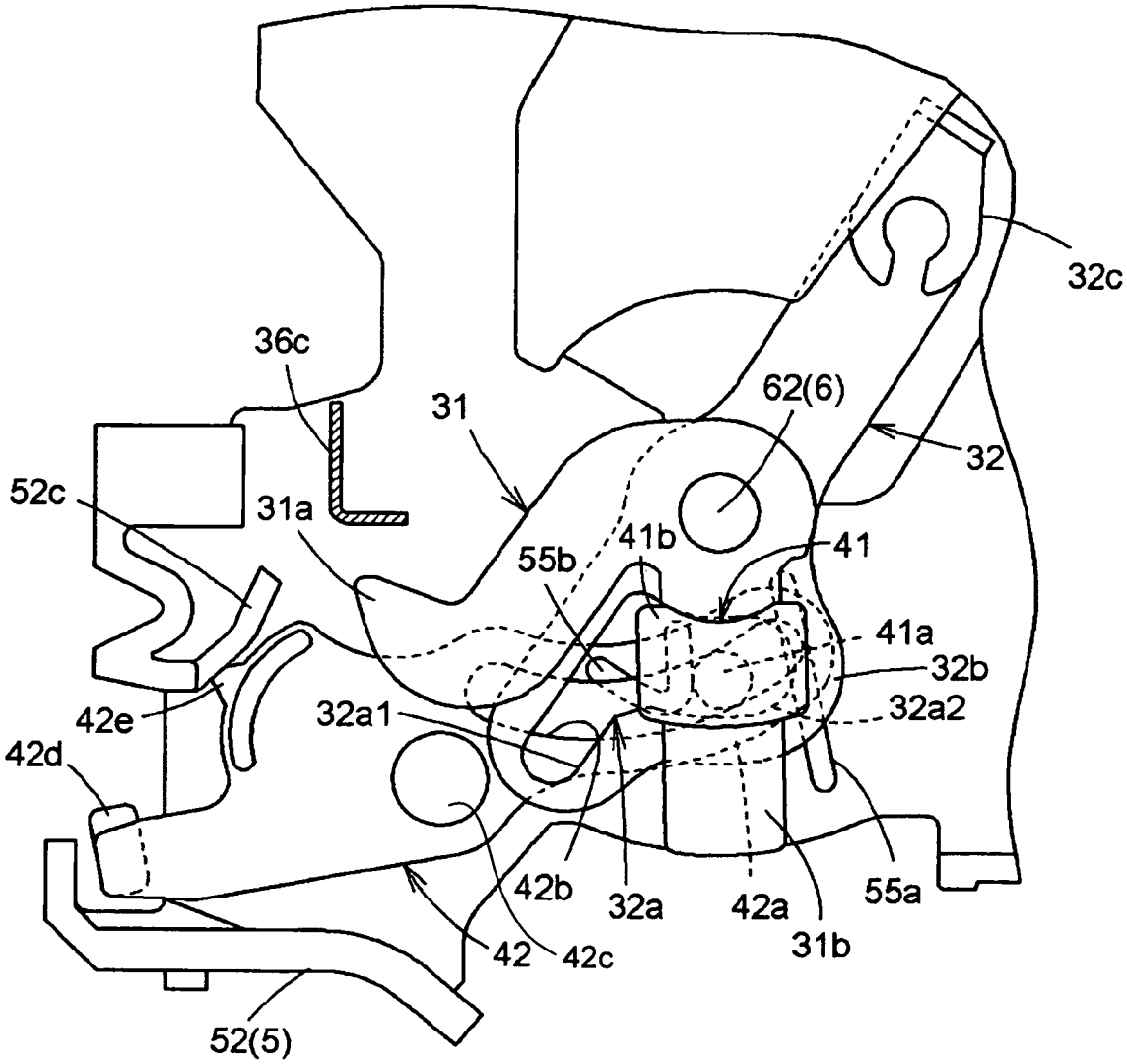
FIG. 12 is a view showing a state in which an inside open lever is fully rotated in an unlatched direction from the state shown in FIG. 11.

According to the present embodiment, as shown in FIGS. 6 and 11, the first guide portion 55*a* and the second guide portion 55*b* of the guide portion 55 are respectively positioned on both sides of the engaging pin 41*a* as in the release position in a peripheral direction relative to the pivot shaft 6 so as to restrict the rotation of the engaging pin 41*a* (see FIG. 9). Precisely, the first area 55*a*1 of the first guide portion 55*a* and the linear guide area 55*b*1 of the second guide portion 55*b* facing each other are positioned on both sides of the engaging pin 41*a* as in the release position in the peripheral direction relative to the pivot shaft 6. Accordingly, the first area 55*a*1 of the first guide portion 55*a* and the linear guide area 55*b*1 of the second guide portion 55*b* constitute a restricting projection portion 56 for restricting the movement of the engaging pin 41*a*, which is in the release position, in the peripheral direction relative to the pivot shaft 6. At this time, the restricting projection portion 56 is arranged such that the inside open lever 31 rotating along with the engaging pin 41*a* is prevented from contacting with other members of the vehicle door lock device 1 even if the engaging pin 41*a* in the release position is fully rotated within an area restricted by the restricting projection portion 56. That is, in cases where the engaging pin 41*a* is in the engaging position and thus the inside open lever 31 and the inside lever 32 are integrally connected to each other, the inside open lever 31 is prevented from rotating by vibration of the vehicle and the like, since the inside lever 32 is held by the cable 32*d* (see FIG. 1). However, in cases where the engaging pin 41*a* is in the release position, the inside open lever 31 is rotatable relative to the inside lever 32 within an area defined by a movement of the engaging pin 41*a* in the elongated bore 32*a*. Then, according to the vehicle door lock device 1 of the present embodiment, the rotation of the inside open lever 31, which is caused by vibration of the vehicle and the like, is restricted by restricting the rotation of the engaging pin 41*a* in the release position by means of the restricting projection portion 56. Thus, the inside open lever 31 is prevented from hitting other members of the vehicle door lock device 1.

Especially, according to the vehicle door lock device 1 of the present embodiment, the arm portion 31*a* of the inside open lever 31 is rotated in the unlatched direction (i.e. clockwise direction in FIG. 6) relative to the pivot shaft 6 so as to be made contact with the contact portion 36*c* of the open link 36. Thus, there is a problem of hitting between the arm portion 31*a* of the inside open lever 31 and the contact portion 36*c* of the open link 36. That is, as shown in FIG. 6, when the inside lever 32 is in the initial position, the rotation of the engaging pin 41*a* in the clockwise direction is restricted to a certain degree by the elongated bore 32*a* of the inside lever 32. Thus, the inside open lever 31 is prevented from widely rotating in the unlatched direction. However, as shown in FIG. 11, when the inside door handle is operated with the engaging pin 41*a* in the release position and the inside lever 32 is rotated relative to the pivot shaft 6 from the initial position shown in FIG. 6 to the unlatched direction, the engaging pin 41*a* is rotatable in the unlatched direction and therefore the inside open lever 31 is rotatable in the unlatched direction. Then, the restricting projection portion 56 is arranged for the purposes of preventing the hitting between the arm portion 31*a* and the contact portion 36*c* caused by the rotation of the inside open lever 31 in the unlatched direction. Precisely, the linear guide area 55*b*1 of the second guide portion 55*b* constituting one side (i.e. unlatched side) of the restricting projection portion 56 is arranged such that the arm portion 31*a* is prevented from contacting with the contact portion 36*c* of the open link 36 in a state in which the inside open lever 31 is fully rotated in the unlatched direction and the engaging pin 41*a* is in contact with the linear guide area 55*b*1. Accordingly, the arm portion 31*a* is prevented from hitting the contact portion 36*c* of the open link 36 as the rotation of the inside open lever 31 caused by the vibration of the vehicle and the like is restricted, thereby preventing occurrence of the hitting noise.

Further, the pivot guide area 55*b*2 of the second guide portion 55*b* of the guide portion 55 guides the engaging pin 41*a* when the operating lever 42 is operated to the child lock position side and thus the engaging pin 41*a* is moved to the release position side (not shown) in a state, as shown in FIG. 10, in which the inside door handle is operated so that the inside lever 32 and the inside open lever 31 are integrally rotated to the unlatched direction. That is, when in such circumstances the inside door handle is released, the inside lever 32 and the inside open lever 31 are rotated to the vehicle installation direction (i.e. latched direction, counterclockwise direction in FIG. 10) and returned to the initial position shown in FIG. 5. Therefore, the engaging pin 41*a* is rotated together with the inside open lever 31 while sliding along a wall face of the pivot guide area 55*b*2 of the second guide portion 55*b*. At this time, the engaging pin 41*a* is pushed in a downward direction in FIGS. 5 and 10 by means of the wall face of the pivot guide area 55*b*2. However, the pivot guide area 55*b*2 and the contact wall 52*c* are formed such that even if the engaging pin 41*a* is fully pushed in the downward direction, i.e. the engaging pin 41*a* is in a boundary position between the pivot guide area 55*b*2 and the linear guide area 55*b*1 of the second guide portion 55*b*, the elastic projecting portion 42*e* of the operating lever 42 is prevented from climbing over the apex of the contact wall 52*c*. Accordingly, when the inside open lever 31 is moved to the initial position shown in FIG. 5, the operating lever 42 is returned to the child lock position side by means of the elastic force of the elastic projecting portion 42*e*, thereby achieving the return of the engaging pin 41*a* to the release position.

Next, a basic operation of the vehicle door lock device 1 is explained. FIG. 3 shows the link mechanism 3 of the vehicle door lock device 1 in the unlocked state so that the vehicle door Y can be opened with the latch mechanism 2 in the latched state. In such circumstances when the outside door handle 1*a* is operated, the outside open lever 35 is operated, thereby bringing the open link 36 to move in an upward direction in FIG. 3. Alternatively, when the inside door handle is operated, the inside lever 32 and the inside open lever 31 are rotated in the unlatched direction (i.e. clockwise direction in FIG. 5) relative to the pivot shaft 6. Then, the arm portion 31*a* of the inside open lever 31 pushes the contact portion 36*c* of the open link 36 in the upward direction (see FIG. 2), thereby bringing the open link 36 to move in the upward direction in FIG. 3. With the upward movement of the open link 36, the flange portion 34*b* is pushed by the contact portion 36*c* and then the lift lever 34 is rotated. Accordingly, the pawl 24, which is rotated as a unit with the lift lever 34, is operated, thereby achieving the unlatched state of the latch mechanism 2 in which the vehicle door Y can be opened.

When the actuator 7 is driven or a lock knob (not shown) is operated in the state shown in FIG. 3 and then the locking lever 33 is rotated in the locked direction of the vehicle door Y (i.e. counterclockwise direction in FIG. 3), the position of the open link 36 linked to the tip end portion 33Ba of the sub-lever 33B is switched to the locked position as shown in FIG. 4. The vehicle door lock device 1 is brought to the locked state accordingly. That is, in cases where the open link 36 is in the locked position, the flange portion 34*b* of the lift lever 34 is not located on the operating path of the contact portion 36*c* of the open link 36. Therefore, even if the outside door handle 1*a* or the inside door handle is operated, the latch mechanism 2 is not brought to the unlatched state. Further, in cases where the actuator 7 is driven or the lock knob is operated in the state shown in FIG. 4 and thus the locking lever 33 is rotated to the unlocked direction of the vehicle door Y (i.e. clockwise direction in FIG. 4), the position of the open link 36 linked to the tip end portion 33Ba of the sub-lever 33B is switched to the unlocked position as shown in FIG. 3. The vehicle door lock device 1 is brought to the unlocked state accordingly.

Next, an operation of the child lock mechanism 4 of the vehicle door lock device 1 according to the present embodiment is explained below. FIG. 5 shows the child lock mechanism 4 in the child lock release state in which the child lock is ineffective with the engaging pin 41*a* of the slide bush 41 in the engaging position. In this state, the inside lever 32 and the inside open lever 31 are in the engaging state by means of the engaging pin 41*a* of the slide bush 41. Thus, when the inside door handle is operated, the inside lever 32 and the inside open lever 31 are integrally rotated from the initial position shown in FIG. 5 in the unlatched direction (i.e. clockwise direction in FIG. 5) relative to the pivot shaft 6 shown in FIG. 10. Accordingly, the arm portion 31*a* of the inside open lever 31 pushes the contact portion 36*c* of the open link 36 in the upward direction (see FIG. 2), thereby moving the open link 36 in the upward direction in FIG. 3. The latch mechanism 2 is brought in the unlatched state in which the vehicle door Y can be opened accordingly.

FIG. 6 shows the child lock mechanism 4 in the child lock state in which the child lock is effective with the engaging pin 41*a* of the slide bush 41 in the release position. In this state, the engagement between the inside lever 32 and the inside open lever 31 by means of the engaging pin 41*a* is released and thus the relative rotation between the inside lever 32 and inside open lever 31 is permitted. That is, the engaging pin 41*a* in the release position is inserted into the arc-shaped bore portion 32*a*2 of the elongated bore 32*a* of the inside lever 32. The engaging pin 41*a* is relatively movable to the inside lever 32 along the arc-shaped bore portion 32*a*2, thereby allowing the relative rotation between the inside open lever 31 and the inside lever 32. Accordingly, even if the inside door handle is operated, as shown in FIG. 11, the inside lever 32 only is rotated in the unlatched direction (i.e. clockwise direction in FIG. 6) relative to the pivot shaft 6. The inside open lever 31 is not operated and thus the latch mechanism 2 is retained in the latched state. That is, the vehicle door Y is not opened even if the inside door handle is operated.

The position of the engaging pin 41*a* of the slide bush 41 is switched by means of the operation of the operating lever 42 linked to the engaging pin 41*a*. That is, when the operation portion 42*d* is operated from the child lock release position shown in FIG. 5 to rotate in the counterclockwise direction so that the operation portion 42*d* is brought in the child lock position shown in FIG. 6, the engaging pin 41*a* is moved to the release position, thereby enabling the child lock. On the other hand, when the operation portion 42*d* is operated from the child lock position shown in FIG. 6 to rotate in the clockwise direction so that the operation portion 42*d* is brought in the child lock release position shown in FIG. 5, the engaging pin 41*a* is moved to the engaging position, thereby releasing the child lock.

According to the aforementioned embodiment, the restricting projection portion 56 is constituted by a part of the guide portion 55. However, instead, the restricting projection portion 56 may be independently formed from the guide portion 55 for guiding the operating path of the engaging pin 41*a* and restricting the movement of the engaging pin 41*a* as in the release position in the peripheral direction relative to the pivot shaft 6. In this case, in order to prevent occurrence of hitting noise between the arm portion 31*a* of the inside open lever 31 and the contact portion 36*c* of the open link 36, a projection such as a wall as the restricting projection portion 56 may be formed on the unlatched side of the engaging pin 41*a* as in the release position for restricting the engaging pin 41*a* to move to the unlatched side.

Further, according to the aforementioned embodiment, the first cover 52 constitutes the housing 5 the base member. However, instead, the base member may be constituted independently from the housing 5.

Furthermore, according to the aforementioned embodiment, since the inside open lever 31, the inside lever 32, the slide bush 41, and the operating lever 42 as well as the restricting projection portion 56 are formed on one side of the first cover 52, an opening portion into which the engaging pin 41*a* is inserted is not required on the first cover 52. Thus, even if the first cover 52 is constituted to serve as a housing for accommodating therein the inside open lever 31, the inside lever 32, the slide bush 41, and the operating lever 42, the sealing ability of the vehicle door lock device 1 can be still enhanced.

Furthermore, according to the aforementioned embodiment, the restricting projection portion 56 is constituted by a part of the guide portion 55. Thus, strength of the restricting projection portion 56 may be enhanced as compared to a case in which the restricting projection portion 56 is independently formed. A production cost may be also reduced. In addition, since the engaging pin 41*a* is moved to the release position thereof by being restricted by the restricting projection portion 56 while the operating path of the engaging pin 41*a* is guided by the guide portion 55, the restricting projection portion 56 is prevented from interfering with the movement of the engaging pin 41*a*.

Furthermore, according to the aforementioned embodiment, the first cover 52 includes a function as the housing. Thus, as compared to a case in which the first cover 52 is independently formed from the housing, a cost can be reduced.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the sprit of the present invention. Accordingly, it is expressly intended that all such variations, changes and equivalents which fall within the spirit and scope of the present invention as defined in the claims, be embraced thereby.

The invention claimed is:

1. A vehicle door lock device comprising:

a base member on which a pivot shaft is supported;

a first lever rotatably supported on the pivot shaft and linked to a latch mechanism engageable with a striker provided on a vehicle;

a second lever rotatably supported on the pivot shaft and operated in association with a door handle;

an engaging member supported on the first lever so as to be slidable relative thereto and including an engaging pin for engaging the first lever and the second lever with each other in a predetermined engaging position and disengaging the first lever and the second lever from each other in a predetermined release position displaced from the engaging position; and an operating lever linked to the engaging member and bringing the engaging pin to operate between the engaging position and the release position;

the first lever, the second lever, the engaging member, and the operating member being arranged on one side of the base member; wherein the base member includes a restricting projection portion on the one side for restricting a movement of the engaging pin in the release position in a peripheral direction relative to the pivot shaft.

2. A vehicle door lock device according to claim 1, wherein the restricting projection portion is constituted by a part of a guide portion for guiding an operating path of the engaging pin.

3. A vehicle door lock device according to claim 1, wherein the base member constitutes a housing that accommodate therein the first lever, the second lever, the engaging member, and the operating lever.

4. A vehicle door lock device according to claim 2, wherein the base member constitutes a housing that accommodate therein the first lever, the second lever, the engaging member, and the operating lever.

5. A vehicle door lock device according to claim 3, wherein the guide portion includes a first guide portion having a linear shape, and a second guide portion having a substantially V-shape.

6. A vehicle door lock device according to claim 5, wherein the second guide portion includes a linear guide area having a linear shape and facing the first guide portion, and a pivot guide area having an arc shape and formed from an end portion of the linear guide area along a rotation direction of the engaging pin in the engaging position.

7. A vehicle door lock device according to claim 6, wherein the first guide portion includes a first area formed so as to face the linear guide area of the second guide portion, and a second area formed so as not to face the linear guide area of the second guide portion.

8. A vehicle door lock device according to claim 7, wherein the first area of the first guide portion and the linear guide area of the second guide portion face each other.

9. A vehicle door lock device according to claim 1, wherein when the engaging pin is in the release position, the guide portion is positioned on both sides of the engaging pin in a peripheral direction relative to the pivot shaft for restricting a rotation of the engaging pin.

10. A vehicle door lock device according to claim 1, wherein when the engaging pin is in the release position, a rotation of the engaging pin is restricted by the restricting projection portion so as to restrict a rotation of the first lever caused by a vibration of a vehicle and to prevent the first lever from hitting other members.

11. A vehicle door lock device according to claim 6, wherein the engaging pin is rotated with the first lever while sliding along a wall face of the pivot guide area of the second guide portion.

12. A vehicle door lock device according to claim 1, wherein the first lever includes an arm portion which is rotated in an unlatched direction relative to the pivot shaft.

13. vehicle door lock device according to claim 6, wherein the pivot guide area guides the engaging pin in a sate in which the first lever and the second lever are integrally rotated in an unlatched direction.

14. A vehicle door lock device according to claim 3, wherein the housing includes a main case, a first cover, and a second cover.

15. A vehicle door lock device according to claim 1, wherein the second lever includes an elongated bore into which the engaging pin is inserted, the elongated bore being formed on an open lever link portion linked to the first lever.

16. A vehicle door lock device according to claim 15, wherein the elongated bore includes a linear bore portion linearly formed along a longitudinal direction of the open lever link portion, and an arc-shaped bore portion extending in an arc shaped manner.

17. A vehicle door lock device according to claim 16, wherein the elongated bore has a substantially L-shape constituted by the linear bore portion and the arc-shaped bore portion.

* * * * *